US007352992B2

(12) United States Patent
Tsai et al.

(10) Patent No.: US 7,352,992 B2
(45) Date of Patent: Apr. 1, 2008

(54) LOW NOISE BLOCK DOWN CONVERTER WITH INTEGRATED FEEDHORN

(75) Inventors: Tsung-Hsing Tsai, Taipei Hsien (TW); Shih-Hun Chuang, Taipei Hsien (TW); Chun-Ching Wang, Taipei Hsien (TW); Chung-Min Lai, Taipei Hsien (TW)

(73) Assignee: Wistrong Neweb Corp., Taipei Hsien (TW)

( * ) Notice: Subject to any disclaimer, the term of this patent is extended or adjusted under 35 U.S.C. 154(b) by 476 days.

(21) Appl. No.: 11/086,624

(22) Filed: Mar. 22, 2005

(65) Prior Publication Data

US 2005/0219007 A1 Oct. 6, 2005

(30) Foreign Application Priority Data

Mar. 31, 2004 (TW) ..... 93108801 A

(51) Int. Cl.
*H04H 1/00* (2006.01)

(52) U.S. Cl. ..... 455/3.02; 343/700 MS

(58) Field of Classification Search ..... 455/3.02, 455/323, 347; 343/700 MS, 779, 786, 840
See application file for complete search history.

(56) References Cited

U.S. PATENT DOCUMENTS 4,999,592 A * 3/1991 Kanda et al. ..... 333/26
6,801,789 B1 * 10/2004 Kato ..... 455/562.1

* cited by examiner

*Primary Examiner*—Lee Nguyen
(74) *Attorney, Agent, or Firm*—Thomas, Kayden, Horstemeyer & Risley

(57) ABSTRACT

A low noise block down converter with integrated feedhorn (LNBF). A module frame provides an isolating structure and a first receiving portion, both disposed thereon. A first probe and insert element are disposed in the first receiving portion. A connector is mounted on the module frame. First and second printed circuit boards and the isolating structure are disposed in the module frame. The first printed circuit board is coupled to the second printed circuit board. A conducting wire passes through the isolating structure and connects the second printed circuit board to the connector.

16 Claims, 7 Drawing Sheets

LOW NOISE BLOCK DOWN CONVERTER WITH INTEGRATED FEEDHORN

BACKGROUND

The present invention relates to a down converter, and in particular to a low noise block down converter with integrated feedhorn (LNBF).

FIG. 1*a* is a schematic diagram showing a conventional LNBF. The LNBF 100 comprises a module frame 110, a first probe 120, a second probe 130, a connector 140, a first printed circuit board (not shown) and a second printed circuit board 155. The module frame 110 provides a waveguide tube 111, a first receiving portion 112 and a second receiving portion 113. The waveguide tube 111 is disposed on the module frame 110. The first and second receiving portions 112 and 113 are formed on the module frame 110. The first printed circuit board is installed in the module frame 110 and electronically connected to the second printed circuit board 155 and then connected to the connector 140 by a conducting wire 151. The first probe 120 is connected into the first receiving portion 112, a groove. The second probe 130 is connected into the second receiving portion 113. FIG. 1*b* is a cross section of the first probe 120 connected into the first receiving portion 112. The first probe 120 comprises a conducting wire 121 and an insulating material 122 wrapped around the conducting wire 121. The first probe 120 further comprises an abutting portion 123 contacting an edge of the first receiving portion 112. The first probe 120 is L-shaped.

The first receiving portion 112 is a groove to receive the L-shaped first probe 120. However, such a groove interrupts the inner surfaces of the waveguide tube 111 (acting as a resonance chamber). As a result, a deep notch 160 is generated in frequency response in the 12.6-12.7 GHz range, as shown in FIG. 1*c*, which reflects the signals received by the LNBF 100. The deep notch 160 is near the frequency band of the satellite signals processed by the LNBF 100, influencing the output of the LNBF 100.

In FIG. 1*a*, a height difference exists between the second printed circuit board 155 and the connector 140, whereby the conducting wire 151 is necessarily exposed to the air to connect the connector 140. Such an arrangement increases the large voltage standing wave rate (VSWR) beyond 4, thus significantly influence the received signals of the LNBF 100.

FIG. 1*d* is a circuit diagram of a conventional LNBF. The down converter circuit comprises a radio frequency circuit 2100 and an intermediate frequency circuit 2200. The frequency band of radio signals is between 10 GHz and 13 GHz. The frequency band of mid-frequency signals is between 900 MHz and 2500 MHz. The radio frequency circuit 2100 comprises an amplifier 210, filters 220, 221 and 222, a local oscillator 230, and a mixer 240. The intermediate frequency circuit 2200 comprises distribution units 261 and 262, a switch 270, and an amplifier 280. Conventionally, a plurality of radio frequency circuits 2100 and intermediate frequency circuits 2200 are alternately arranged on the first printed circuit board 150 and the second printed circuit board 155. To meet the requirements of radio frequency circuit 2100, both the first printed circuit board 150 and the second printed circuit board 155 are fabricated using material such as PTFE or Rogers, with high costs, accordingly.

SUMMARY

An embodiment of the present invention provides a low noise block down converter with integrated feedhorn (LNBF). The LNBF comprises a module frame, a first probe, an insert element, a connector, a first printed circuit board, a second printed circuit board and a conducting wire. The module frame comprises an isolating structure and a first receiving portion. The first probe and the insert element are disposed in the first receiving portion. The connector is mounted on the module frame. The first printed circuit board and the second printed circuit board are disposed in the module frame and electronically connect to each other. The conducting wire passes through the isolating structure and connects the second printed circuit board and the connector.

According to the present invention, receiving condition of satellite signal can be improved using the insert element by reducing the resonance within the first receiving portion. The isolating structure also isolates the electromagnetic noise generated by conducting wire and reduces the VSWR below 2. The RF circuit is also separated from the lower-frequency circuit, and the two circuits are disposed on two different circuit boards. By reducing the usage of expensive RF circuit board, the present invention also reduces the cost of a LNBF.

A detailed description is given in the following with reference to the accompanying drawings.

DESCRIPTION OF THE DRAWINGS

The present invention can be more fully understood by reading the subsequent detailed description in conjunction with the examples and references made to the accompanying drawings, wherein.

DETAILED DESCRIPTION

Figure 2:
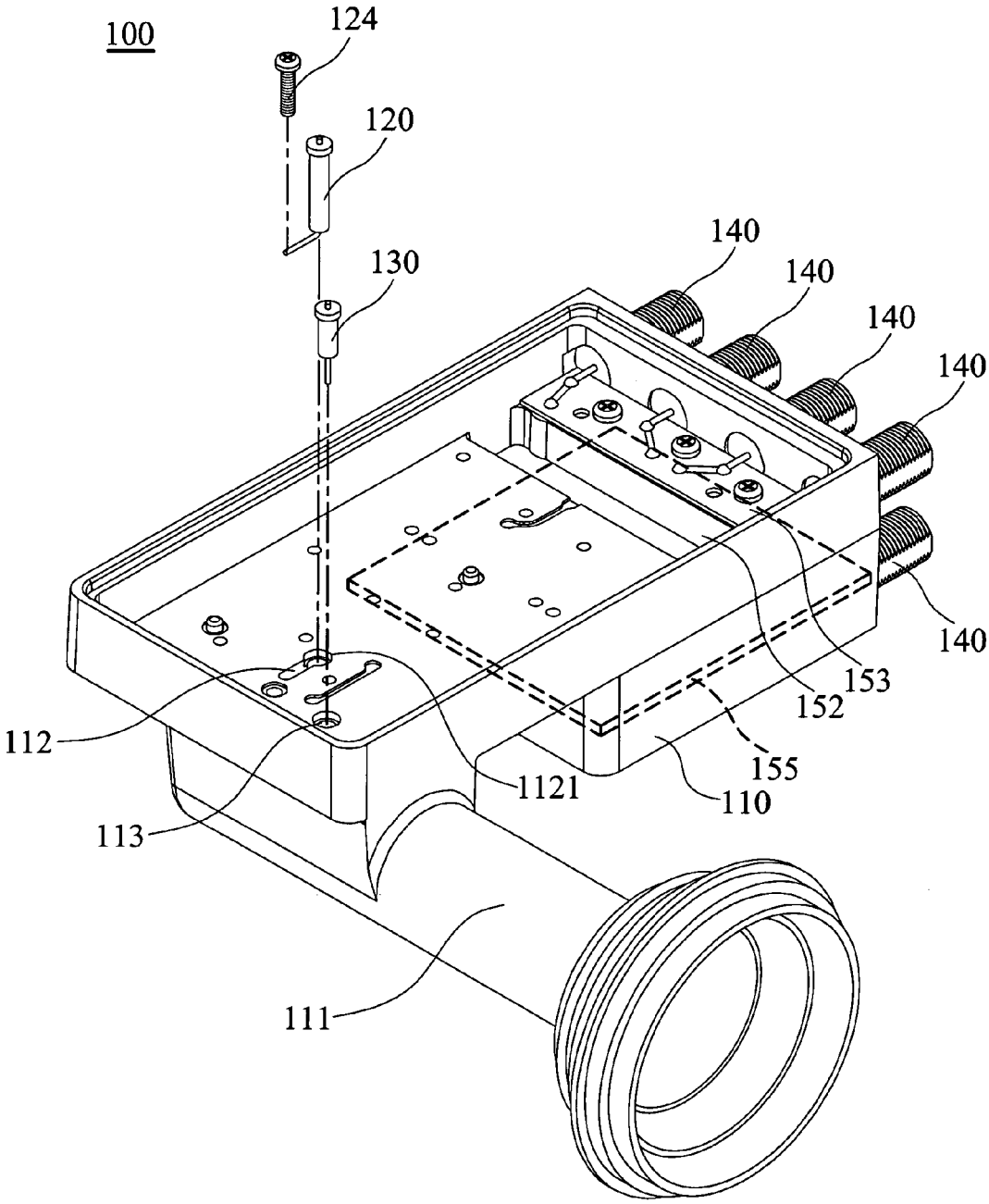
FIG. 2 is a schematic diagram showing a LNBF of an embodiment of the present invention.
Figure 3A:
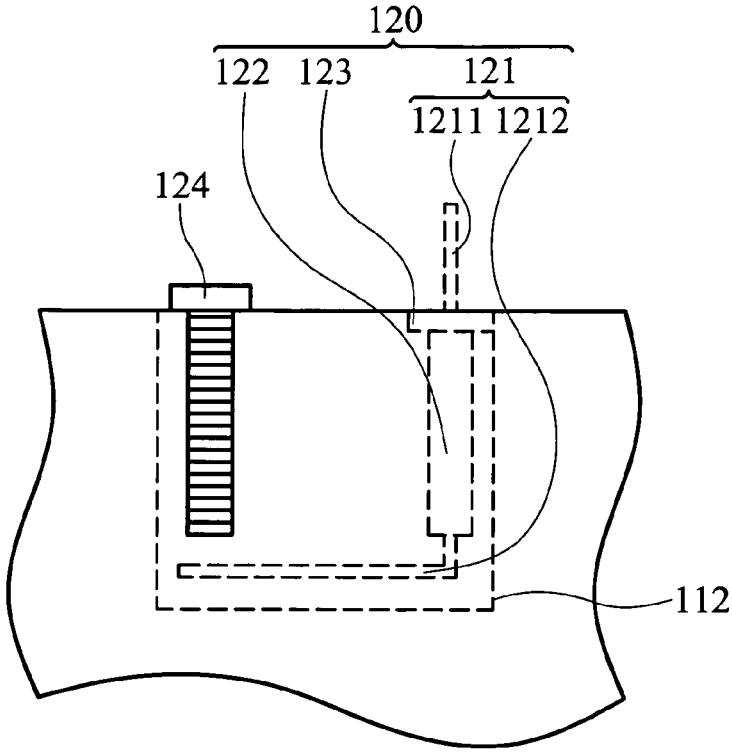
FIG. 3*a* is a local cross section of an insert element connectorged in a first receiving portion.
Figure 4:
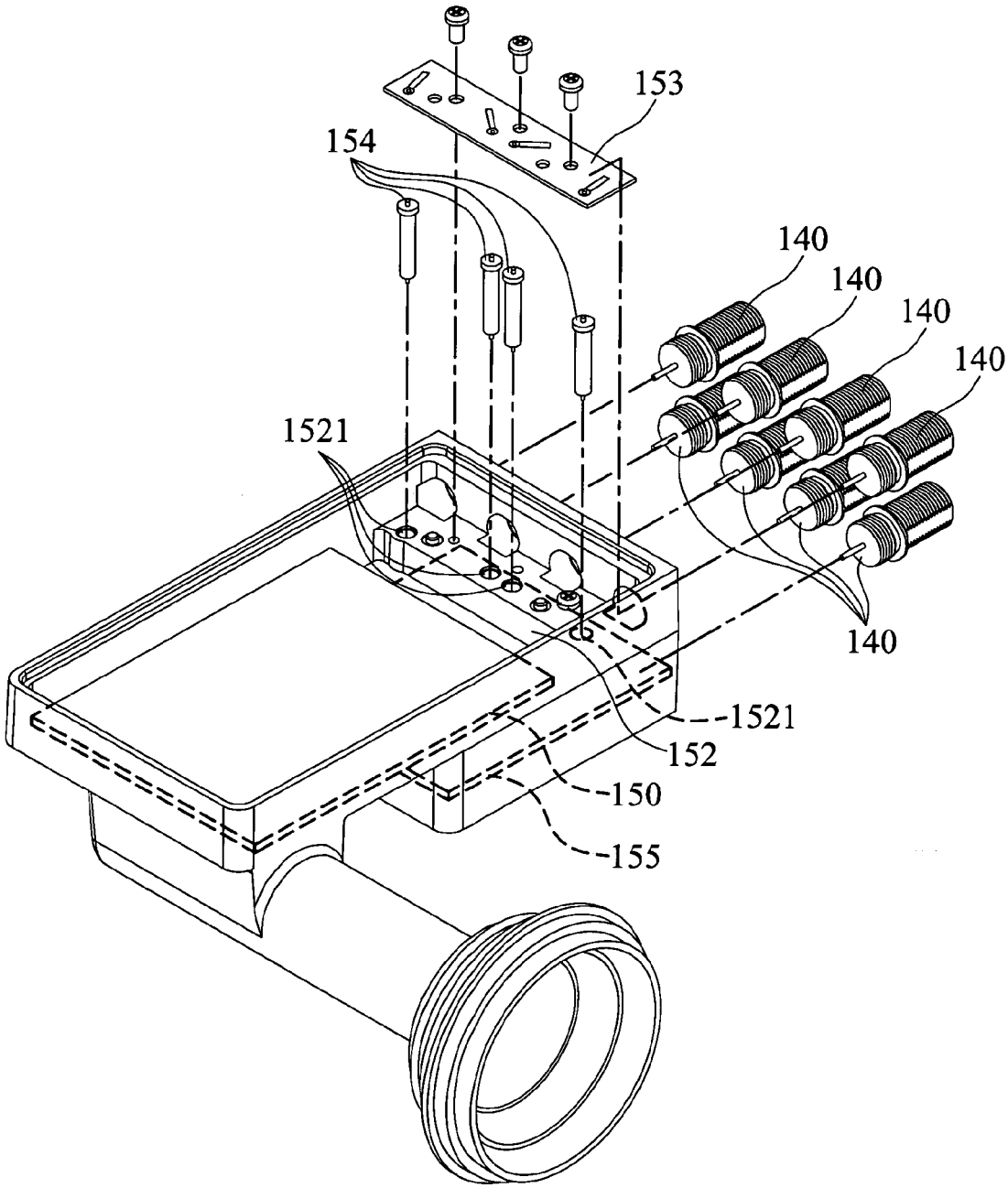
FIG. 4 is a partial schematic diagram showing a LNBF of the embodiment of the present invention.

FIGS. 2 and 4 show a LNBF 100 of an embodiment of the present invention, comprising a module frame 110, a first probe 120, a second probe 130, an insert element 124, a connector 140, a first printed circuit board 150, a second printed circuit board 155, a board 153, and a conducting wire. The module frame 110 comprises an isolating structure 152, a first receiving portion 112, a second receiving portion 113, and a waveguide tube 111. The isolating structure 152, the first receiving portion 112, and the second receiving portion 113 are formed on the module frame 110. The waveguide tube 111 is disposed on the module frame 110. The first receiving portion 112 interlinks the waveguide tube 111. The first receiving portion 112 is a groove structure and provides a circular opening 1121. In this embodiment, the diameter of the circular opening 1121 exceeds the width of the groove. The first probe 120, disposed in the first receiving portion 112, receives a first signal from the waveguide tube 111. The insert element 124 is disposed in the first receiving portion 112 to improve the performance of the received signals, see FIG. 3*a*. The second probe 130 is disposed in the second receiving portion 113 and receives a second signal from the waveguide tube 111. A down converter circuit (not shown) is formed on the first printed circuit board 150 and the second printed circuit board 155 (FIG. 4) for converting the first signal and the second signal to a first down-converted signal and a second down-converted signal. Since the first printed circuit board 150 is electronically connected to the second printed circuit board 155, signals are transmitted between the first printed circuit board 150 and the second printed circuit board 155. The conducting wire 154, surrounded by an insulating coating, passes through the isolating structure 152 and connects the second printed circuit board 155 to the board 153. As a result, the first and second down-converted signals at the second printed circuit board 155 are transmitted to connector 140 via the conducting wire 154 and the conducting strip on board 153.

FIG. 3*a* is a schematic diagram showing the insert element 124 and the first probe 120 in the first receiving portion 112, wherein the first receiving portion 112 is a groove structure. The first probe 120 comprises a first conducting wire 121 and a first insulating material 122. The first conducting wire 121 is divided into a first part 1211 and a second part 1212 that perpendicular to the first part 1211. The first insulating material 122 wraps around the first part 1211 of the conducting wire 121 to form a cylinder. An abutting portion 123 at one end of the first insulating material 122 contacts a fringe (not shown) of the first receiving portion 112. When the first probe 120 is plugged into the first receiving portion 112, the first part 1211 and the first insulating material 122 are located at the circular opening 1121 (shown in FIG. 2). The second part 1212 is seated in the first receiving portion 112, with the second part 1212 that perpendicular to the first part 1211. The insert element 124 is disposed in the first receiving portion 112 opposite the circular opening 1121.

Figure 3B:
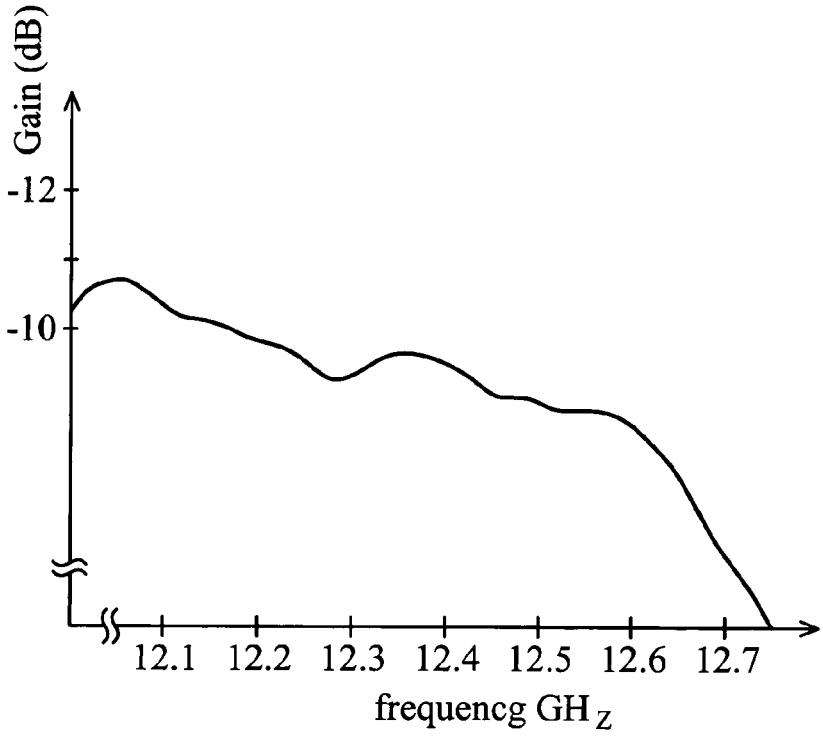
FIG. 3*b* is a schematic diagram showing received signals of the LNBF of the embodiment of the present invention.

The first receiving portion 112 may be a recess having different shape, and the insert element 124 may be a screw or other element that can adjust resonance effect of the receiving portion 112. FIG. 3*b* shows the received signals of the LNBF 100. As a result, the deep notch formed between 12.6 GHz and 12.7 GHz of the prior-art LNBF, is eliminated.

In FIG. 4, the isolating structure 152 is rectangular with through holes 1521 formed therein. The conducting wire 154 passes through the through holes 1521 and electronically connects to the second printed circuit board 155. The second printed circuit board 155 electronically connects to the first printed circuit board 150 via another conducting wire (not shown). An insulating material is formed around the conducting wire 154. Another end of the conducting wire 154 connects to the board 153, and the connector 140 connects to the board 153 as well. The conducting strip on board 153 interconnects conducting wire 154 and the connector 140. Since the conducting wire 154 is wrapped with the insulating material and is embedded within the isolating structure 152, the voltage standing wave rate (VSWR) of the LNBF 100 can be reduced to around or less than 2. The isolating structure 152 may comprise metal and can be integrated with the housing.

Figure 1A:
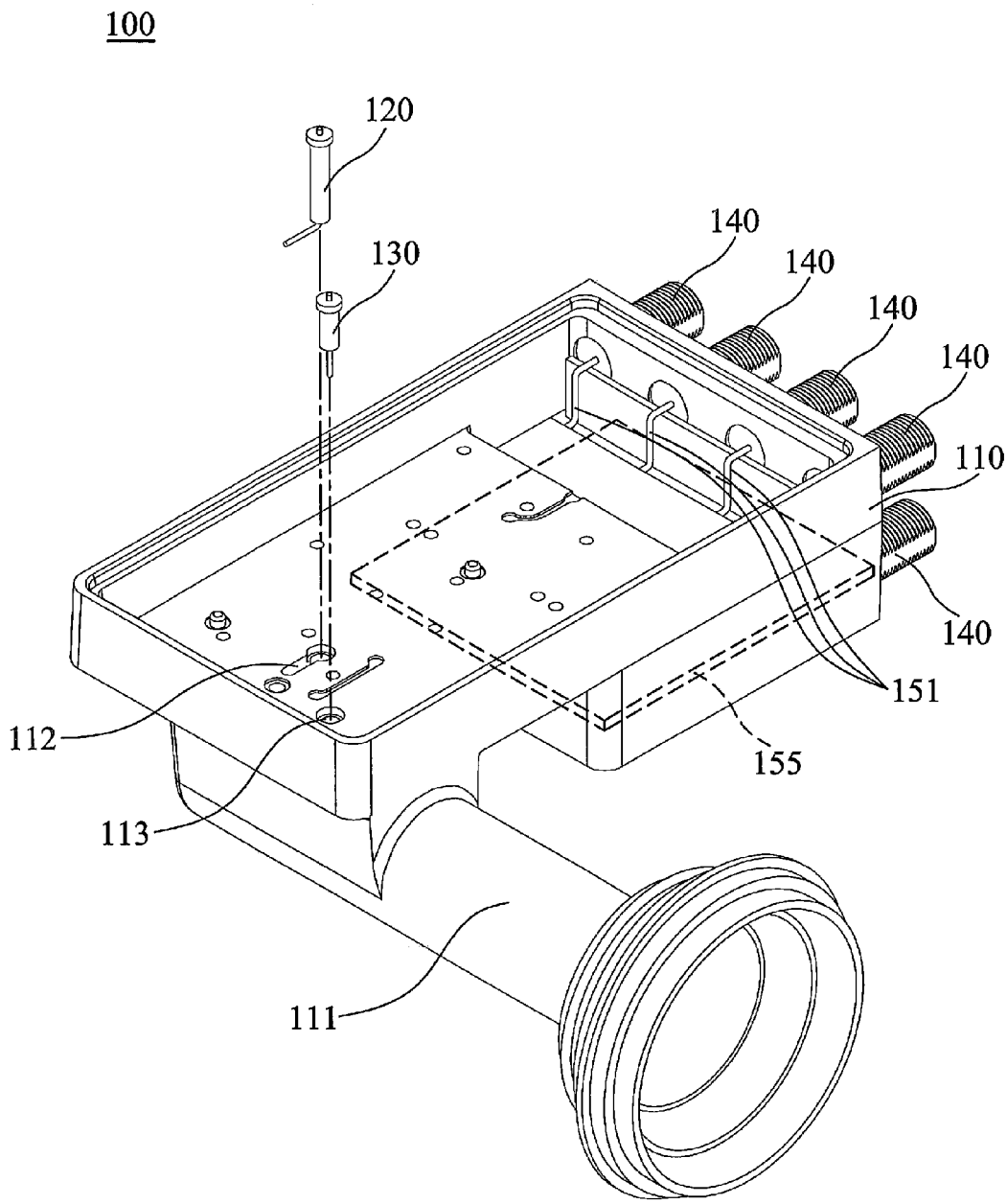
FIG. 1a ( PRIOR ART )
FIG. 1*a* is a schematic diagram showing a conventional LNBF.
Figure 1B:
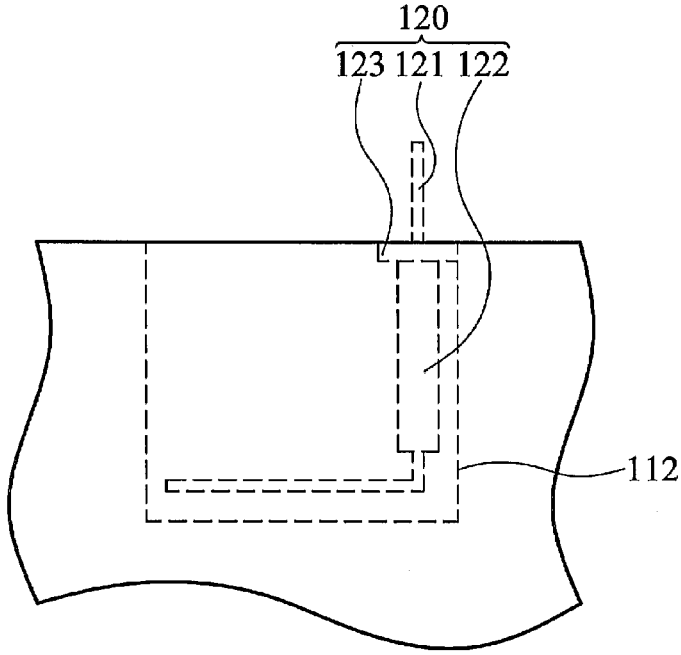
FIG. 1b ( PRIOR ART )
FIG. 1*b* is a local cross section of a first probe in a first receiving portion.
Figure 1C:
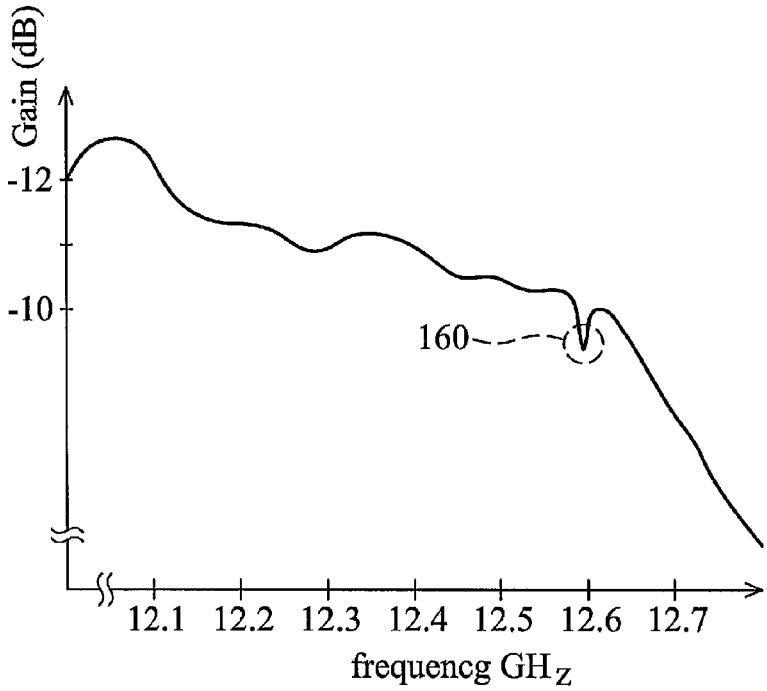
FIG. 1c ( PRIOR ART )
FIG. 1*c* is a schematic diagram showing received signals of the conventional LNBF.
Figure 1D:
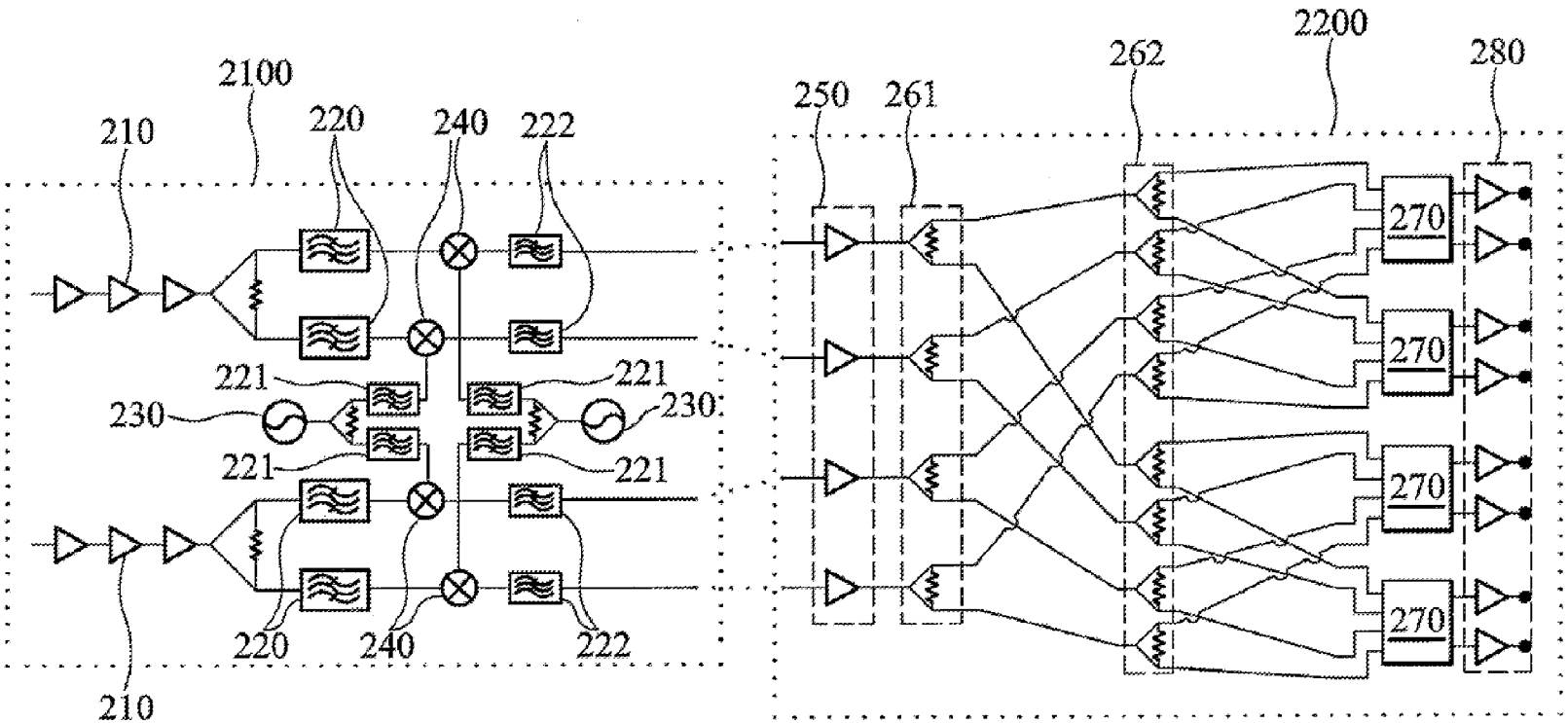
FIG. 1d ( PRIOR ART )
FIG. 1*d* is a circuit-diagram of the conventional LNBF.

Referring to FIG. 1*d*, the down converter circuit of the embodiment of the present invention comprises a radio frequency circuit 2100 and an intermediate frequency circuit 2200. The radio frequency circuit 2100 comprises an amplifier 210, filters 220, 221 and 222, a local oscillator 230 and a mixer 240. The first and the second signals are processed by the radio frequency circuit 2100 to generate a first down-converted signal and a second down-converted signal respectively. The intermediate frequency circuit 2200 comprises an amplifier 250, distribution units 261 and 262, a switch 270, and an amplifier 280. For producing multiple output, the first down-converted signal and the second down-converted signal are split by the intermediate frequency circuit 2200. To reach better performance, the radio frequency circuit 2100 is disposed on the first printed circuit board 150 that is manufactured with good high-frequency characteristics, such as Rogers or PTFE. The intermediate frequency circuit 2200 is disposed on the second printed circuit board 155. The second printed circuit board 155 is fabricated using low-cost epoxy resin material to reduce costs. Moreover, the second printed circuit board 155 can be a four-layer board. The intermediate frequency circuit 2200 is disposed on both sides of the second printed circuit board 155.

In this embodiment, the first signal and the second signals can be RF signals with frequency between 10 GHz and 13 GHz. The frequency of the first down-converted signal and the second first down-converted signal are between 900 MHz and 2500 MHz.

Figure 5:
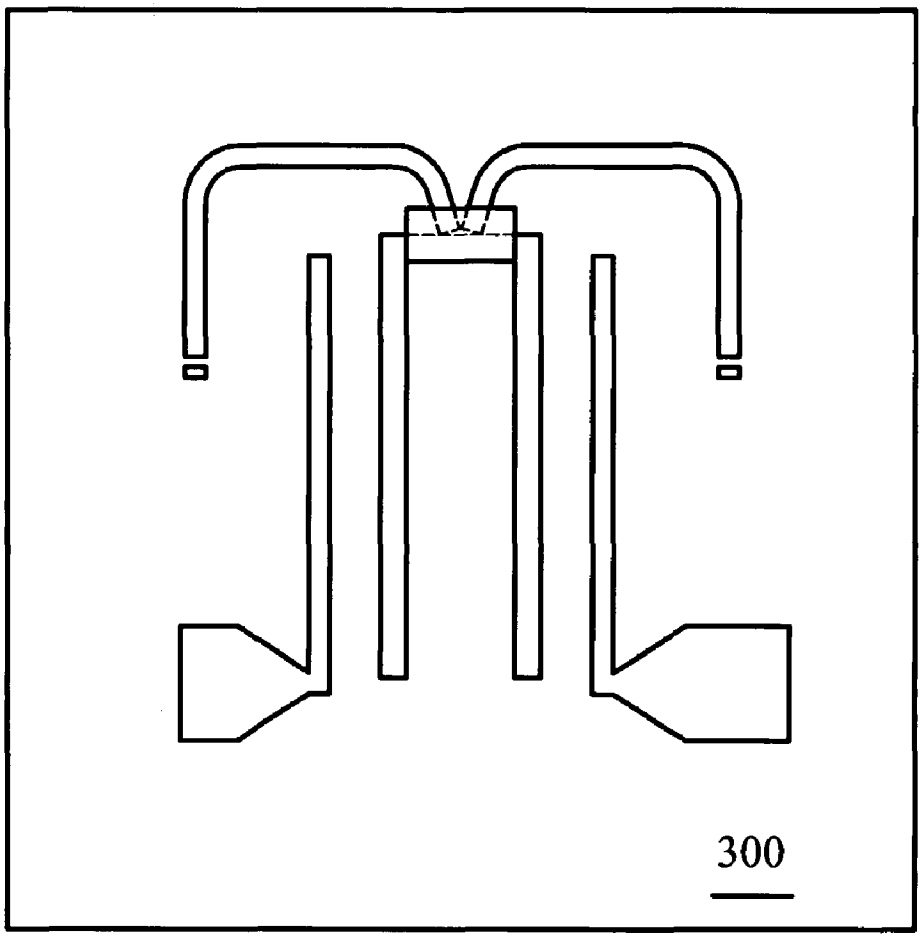
FIG. 5 is a schematic diagram of the modify hairpin filter.

The filter 221 is for filtering unwanted twofold frequency noises generated by the local oscillator 230. The filter 221 can be an interdigital filter or a modified hairpin filter. The cycle of the interdigital filter is three times that of the base frequency. FIG. 5 is a circuit structure of the modified hairpin filter. For technology of the modified hairpin filter please refer to a publication "Hairpin filters with tunable transmission zeros, IEEE".

A discontinuous resonance generated from the receiving portion of the LNBF is eliminated by the insert element. Thus, the performance of the received signals is improved. isolating structure. By isolating the undesired electromagnetic emission, the isolating structure effectively reduced the VSWR of the LNBF to about or less than 2. To reduce costs, the radio frequency circuit and the intermediate frequency circuit of the LNBF are separately disposed on a first printed circuit board and a second printed circuit board of different material.

While the invention has been described by way of example and in terms of preferred embodiments, it is to be understood that the invention is not limited thereto. On the contrary, it is intended to cover various modifications and similar arrangements apparent to those skilled in the art. Therefore, the scope of the appended claims should be accorded the broadest interpretation so as to encompass all such modifications and similar arrangements.

What is claimed is:

1. A low noise block down converter with integrated feedhorn (LNBF), comprising:

a module frame comprising a waveguide tube, a first receiving portion and a second receiving portion, the waveguide tube being connected to the first receiving portion and the second receiving portion;

a first probe disposed in the first receiving portion and extended into the waveguide tube for receiving a first signal from the waveguide tube;

a second probe disposed in the second receiving portion and extended into the waveguide tube for receiving a second signal from the waveguide tube;

an insert element disposed in the first receiving portion for blocking an empty space within the first receiving portion; and a down converter circuit coupled to the first probe to process the received first signal.

2. The low noise block down converter with integrated feedhorn as claimed in claim 1, wherein the first probe is L-shaped.

3. The low noise block down converter with integrated feedhorn as claimed in claim 1, wherein the first probe comprises a first part, a second part, and a first insulating material, wherein the first part is perpendicular to the second part and the first insulating material encompassing the first part.

4. The low noise block down converter with integrated feedhorn as claimed in claim 1, wherein the first receiving portion comprises a groove and a circular opening is formed on one end of the groove, the diameter of the circular opening exceeds the width of the groove.

5. The low noise block down converter with integrated feedhorn as claimed in claim 1, wherein the insert element is a screw fastened into the first receiving portion.

6. A low noise block down converter with integrated feedhorn (LNBF), comprising:

a module frame having an isolating structure and a waveguide tube, the isolating structure being disposed in the module frame and the isolating structure comprising a through hole;

a connector;

a down converter circuit disposed in the module frame to receive a first signal from the waveguide tube and down-convert the first signal to generate a first down-converted signal; and a conducting wire passing through the isolating structure via the through hole and electronically connecting the down converter circuit to the connector for transmitting the first down-converted signal to the connector;

a board, disposed on the isolating structure, wherein the board interconnects between the conducting wire and the connector, and the first down-converted signal is transmitted from the down converter circuit to the connector through the conducting wire and the board.

7. The low noise block down converter with integrated feedhorn as claimed in claim 6, wherein the isolating structure is rectangular.

8. The low noise block down converter with integrated feedhorn as claimed in claim 6, wherein the isolating structure is integrated with the module frame.

9. The low noise block down converter with integrated feedhorn as claimed in claim 6, wherein the conducting wire further comprises an insulating outer layer.

10. A low noise block down converter with integrated feedhorn (LNBF), comprising:

a module frame having a waveguide tube, a first receiving portion, a second receiving portion and an isolating structure, wherein the waveguide tube is connected to the first receiving portion and the second receiving portion, and the isolating structure is disposed in the module frame and comprising a through hole;

a first probe disposed in the first receiving portion and extended into the waveguide tube for receiving a first signal from the waveguide tube;

a second probe disposed in the second receiving portion and extended into the waveguide tube for receiving a second signal from the waveguide tube;

an insert element disposed in the first receiving portion for blocking an empty space within the first receiving portion;

a connector;

a down converter circuit coupled to the first probe for receiving the first signal from the first probe and processing the first signal to generate a first down-converted signal; and a conducting wire passing through the isolating structure via the through hole and electronically connecting the down converter circuit and the connector to transmit the first down-converted signal from the down converter circuit to the connector through the conducting wire.

11. The low noise block down converter with integrated feedhorn as claimed in claim 10, further comprising a first printed circuit board and a second printed circuit board with a substrate material different from that of the first printed circuit board, the down converter circuit comprising a radio frequency circuit and an intermediate frequency circuit, wherein the radio frequency circuit is disposed on the first printed circuit board to convert the first signal to a first intermediate frequency signal, and the intermediate frequency circuit is disposed on the second printed circuit board for receiving the first intermediate frequency signal from the radio frequency circuit and converting the first intermediate frequency signal to the first down-converted signal.

12. The low noise block down converter with integrated feedhorn as claimed in claim 11, wherein the second printed circuit board is a four-floor board.

13. The low noise block down converter with integrated feedhorn as claimed in claim 10, wherein the frequency of the first signal is between 10 GHz and 13 GHz and the first down-converted signal is between 900 MHz and 2500 MHz.

14. The low noise block down converter with integrated feedhorn as claimed in claim 10, wherein the first probe is L-shaped.

15. The low noise block down converter with integrated feedhorn as claimed in claim 10, wherein the first receiving portion comprises a groove and a circular opening is formed on one end of the groove, and wherein the insert element is a screw fastened into the first receiving portion.

16. The low noise block down converter with integrated feedhorn as claimed in claim 10, further comprising a board disposed on the isolating structure, wherein the board interconnects between the conducting wire and the connector and the first down-converted signal is transmitted from the down converter circuit to the connector through the conducting wire and the board.

* * * * *

UNITED STATES PATENT AND TRADEMARK OFFICE

CERTIFICATE OF CORRECTION

PATENT NO. : 7,352,992 B2
APPLICATION NO. : 11/086624
DATED : April 1, 2008
INVENTOR(S) : Tsung-Hsing Tsai et al.

It is certified that error appears in the above-identified patent and that said Letters Patent is hereby corrected as shown below:

On the Title Page:

item (73) - delete the Assignee name Wistrong Neweb Corp., Taipei Hsien (TW) and replace with --Wistron Neweb Corp.., Taipei Hsien (TW)--

Signed and Sealed this

Eighth Day of July, 2008

JON W. DUDAS
*Director of the United States Patent and Trademark Office*